US009032845B2

(12) United States Patent
Lin

(10) Patent No.: US 9,032,845 B2
(45) Date of Patent: May 19, 2015

(54) RATCHET WRENCH

(76) Inventor: Li-Ching Lin, Chiayi County (TW)

( * ) Notice: Subject to any disclaimer, the term of this patent is extended or adjusted under 35 U.S.C. 154(b) by 408 days.

(21) Appl. No.: 13/523,862

(22) Filed: Jun. 14, 2012

(65) Prior Publication Data

US 2013/0333525 A1 Dec. 19, 2013

(51) Int. Cl.
*B25B 13/46* (2006.01)

(52) U.S. Cl.
CPC ..... *B25B 13/463* (2013.01)

(58) Field of Classification Search
CPC .. B25B 13/463; B25B 13/461; B25B 13/465; B25B 23/0035; B25B 13/46; B25B 13/14; B25B 15/04
USPC ..... 81/60, 61, 62, 63, 63.1, 63.2
See application file for complete search history.

(56) References Cited

U.S. PATENT DOCUMENTS

| | | | | |
|---|---|---|---|---|
| 6,609,444 | B1 * | 8/2003 | Hsien | 81/63.2 |
| 6,918,323 | B2 * | 7/2005 | Arnold et al. | 81/63.2 |
| 8,763,498 | B2 * | 7/2014 | Hsieh | 81/63.2 |

* cited by examiner

*Primary Examiner* — Robert Scruggs

(57) ABSTRACT

A ratchet wretch includes a first recess, a second recess and a third recess. A ratchet wheel is rotatably located in the first recess and a pawl is located in the second recess. The pawl has a curved recess defined in the rear side thereof and a protrusion extending therefrom. A first face is defined between the protrusion and the curved recess. A second face is defined in the pawl and located away from the third recess. The rotatable unit comprises a rotatable member, a first hat and a resilient member. The rotatable unit has a circular rod pivotably connected to the third recess. The circular rod has a restriction slot and three top surfaces. One of the top surfaces contacts the second face to restrict the rotatable member from disengaging from the third recess. The first hat and the resilient member are located in the restriction slot.

8 Claims, 7 Drawing Sheets

RATCHET WRENCH

FIELD OF THE INVENTION

The present invention relates to a ratchet wrench, and more particularly, to a pawl of the ratchet wrench having a first face and a second face, the top surface of the rotatable member contacting the second face, the first push member contacting the first face, the top surface and the first push member being restricted by the pawl to pivotably connected to the rotatable member in the third recess.

BACKGROUND OF THE INVENTION

U.S. Pat. No. 2,957,377 discloses a ratchet wrench and comprises a ratchet wheel, a pawl, a rotatable member and a resilient member. The wrench has a first recess, a second recess and a third recess, wherein the pawl is pivotably located in the first recess and has ratchet teeth. The pawl is located in the second recess and has teeth which are engaged with the ratchet teeth. The pawl further has a notch. The rotatable member is pivotably located in the third recess and has a restriction slot. The resilient member has one end engaged with the notch and the other end of the resilient member is engaged with the restriction slot. The rotatable member is rotated to drive the resilient member an angle and the resilient member moves the pawl in the second recess to control the wrench to be functioned clockwise or counter clockwise. The resilient member has one end engaged with the notch and the pawl restricts the resilient member. The other end of the resilient member is engaged with the restriction slot and the resilient member restricts the rotatable member so that the rotatable member is restricted in the third recess. The rotatable member has an annular groove and a clip which is engaged with the annular groove. The clip is further engaged with the inner periphery of the third recess so that the rotatable member is maintained in the third recess and does not drop from the third recess. However, the clip in the annular grove is engaged with the inner periphery of the third recess by friction, basically, the pawl restricts the resilient member and the resilient member restricts the rotatable member, so that when the wrench drops on the floor, the rotatable member can be easily disengaged from the third recess.

U.S. Pat. No. 6,282,992 disclose a ratchet wrench and comprises a ratchet wheel, a pawl, a rotatable member and a resilient member. A spring hat is mounted to the resilient member. The spring hat has one end engaged with the notch of the pawl and the other end of the spring hat is engaged with the restriction slot of the rotatable member, so that the rotatable member is located in third recess and is not disengaged from the third recess. Again, when the wrench drops on the floor, the rotatable member can be easily disengaged from the third recess because the rotatable member is solely restricted by the spring hat.

The present invention intends to provide the ratchet wrench whose pawl has a first face and a second face. The top surface of the rotatable member contacts the second face and the first push member contacts the first face. The top surface and the first push member are restricted by the pawl to pivotably connect the rotatable member in the third recess.

SUMMARY OF THE INVENTION

The present invention relates to a ratchet wretch and comprises a first recess, a second recess and a third recess. A ratchet wheel is rotatably located in the first recess and a pawl is located in the second recess. The pawl has a curved recess defined in the rear side thereof and a protrusion extending therefrom. A first face is defined between the protrusion and the curved recess. A second face is defined in the pawl and located away from the third recess. The rotatable unit comprises a rotatable member, a first hat and a resilient member. The rotatable unit has a circular rod which is pivotably connected to the third recess. The circular rod has a restriction slot and three top surfaces. One of the top surfaces contacts the second face to restrict the rotatable member from disengaging from the third recess. The first hat and the resilient member are located in the restriction slot. The first hat contacts the first face and the first hat restricts the rotatable member in the third recess.

The top surface of the rotatable member contacts the second face of the pawl and the first hat contacts the first face, so that the pawl restricts the rotatable member and the first hat. The first hat is located in the restriction slot so that the rotatable unit is pivotably located in the third recess and is not disengaged from the third recess. The rotatable unit has two restriction designs, when the ratchet wrench receives an impact, the rotatable member is not disengaged from the third recess. The pawl has the protrusion which performs as a rib to bear higher torque.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
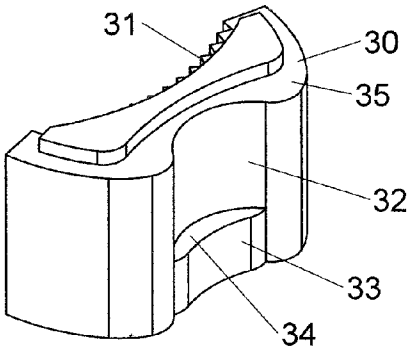
FIG. 2 is a perspective view to show the pawl of the present invention.
Figure 1:
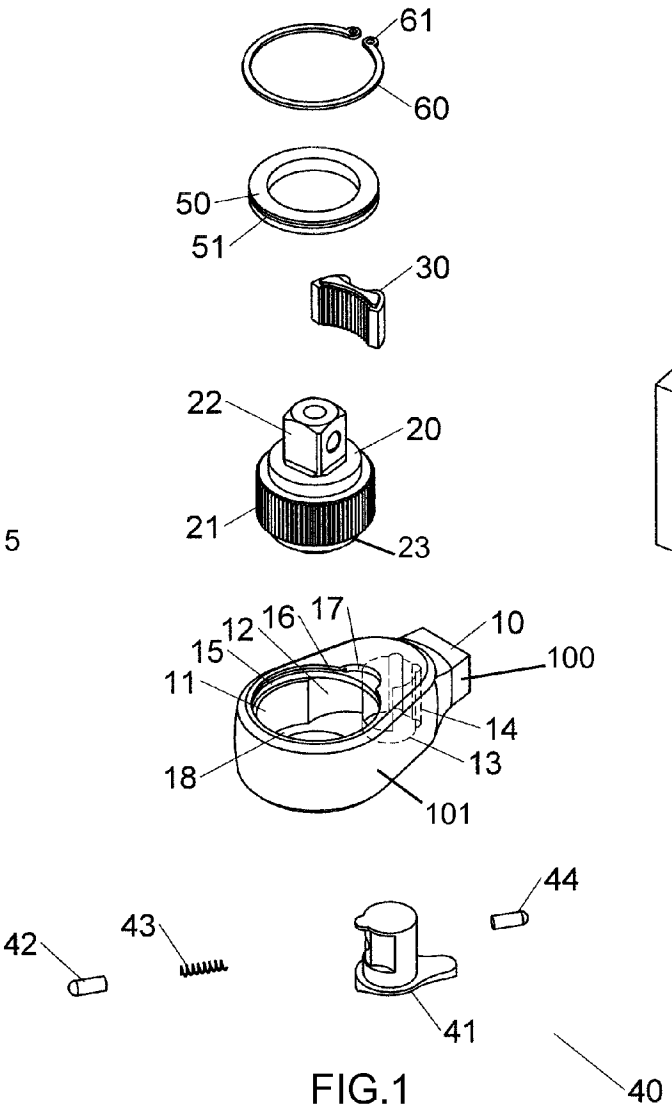
FIG. 1 is an exploded view to show the ratchet wrench of the present invention.
Figure 3:
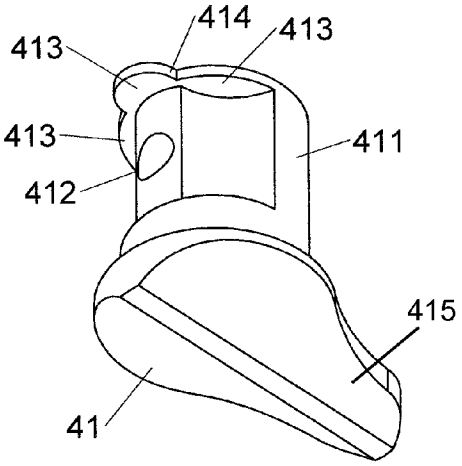
FIG. 3 is a perspective view to show the rotatable member of the present invention.
Figure 4:
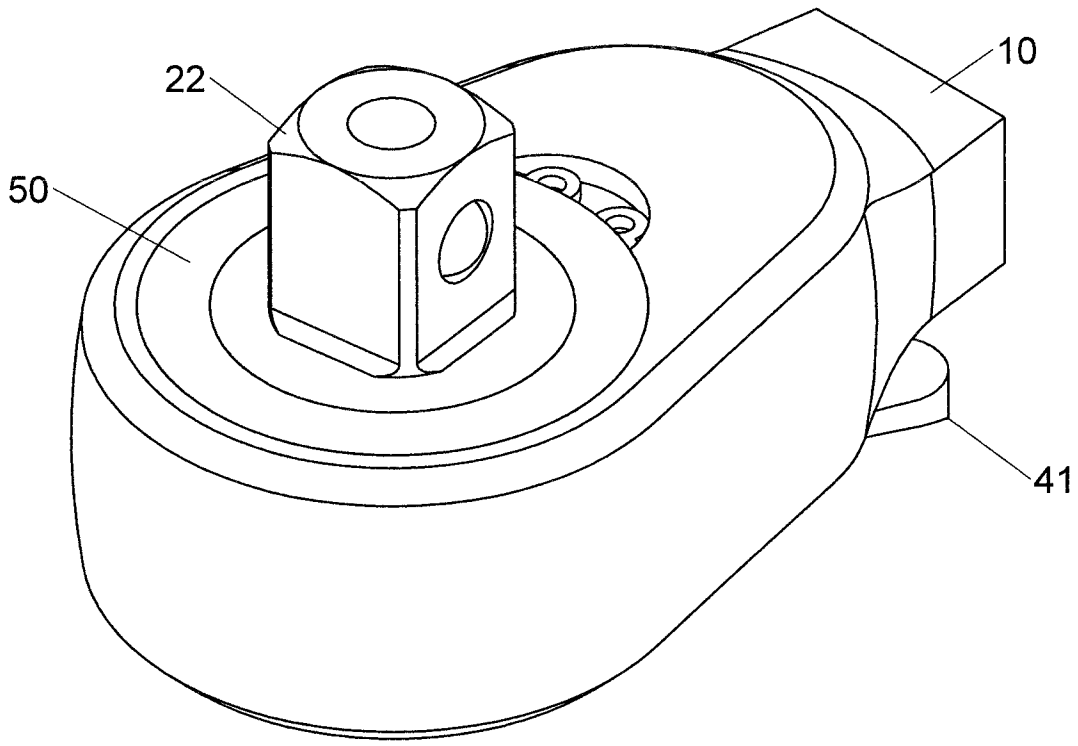
FIG. 4 is a perspective view to show the ratchet wrench of the present invention.

Referring to FIGS. 1 to 4, the ratchet wretch 10 of the present invention comprises a ratchet wheel 20, a pawl 30, a rotatable unit 40, a cover 50 and a clip 60. The ratchet wrench 10 comprises a handle 100 and a function end 101 connected to an end of the handle 100. The function end 101 has a first recess 11 and a second recess 12 is defined in the inner periphery of the first recess 11 which communicates with the second recess 12. The diameter of the second recess 12 is smaller than that of the first recess 11. The center of the second recess 12 is located within the first recess 11. The top and the bottom of the second recess 12 are closed. A third recess 13 is defined in the function end 101 and communicates with the second recess 12. The third recess 13 has an open end. Two positioning portions 14 are located at the third recess 13 and close to the handle 100. A cover groove 15 is defined in the inner periphery of the first recess 11 and the diameter of the cover groove 15 is larger than that of the first recess 11. An engaging groove 16 is defined in the upper periphery of the cover groove 15. A notch 17 is defined in end surface of the function end 101 and communicates with the engaging groove 16. The first recess 11 has a lip 18 extending from the bottom thereof. The ratchet wheel 20 is rotatably located in the first recess 11 and has ratchet teeth 21 defined in the outer periphery thereof. The ratchet wheel 20 has a mounting part 22 extending therefrom. The mounting part 22 has a rectangular cross section. The ratchet wheel 20 has a contact portion 23 which contacts the lip 18. The pawl 30 is located in the second recess 12 and movable left and right in the second recess 12. The pawl 30 has multiple engaging teeth 31 defined in the front side thereof. The engaging teeth 31 are engaged with the ratchet teeth 21. The pawl 30 has a curved recess 32 defined in the rear side thereof. The pawl 30 has a protrusion 33 extending therefrom which is located close to the open end of the third recess 13. A first face 34 is defined between the protrusion 33 and the curved recess 32, and a second face 35 is defined in the pawl 30 and located away from the open end of the third recess 13. The rotatable unit 40 is located in the third recess 13 so as to control the pawl 30 to move in the second recess 12 to control the ratchet wrench to be function clockwise or counter clockwise. The rotatable unit 40 has a rotatable member 41, a first hat 42, a resilient member 43 and a second hat 44. The rotatable member 41 has a circular rod 411 which is pivotably connected to the third recess 13 and has a restriction slot 412. The restriction slot 412 is located corresponding to the curved recess 32 of the pawl 30. The circular rod 411 has three top surfaces 413 which face the pawl 30. At least one of the top surfaces 413 contacts the second face 35 so that the rotatable member 41 is not disengaged from the third recess 13. The top surface 413 that is located at middle of the three top surfaces 413 has a top flange 414 on each of two sides thereof. When the rotatable unit 40 is rotated in the third recess 13, one of the top flanges 414 of the rotatable member 41 contacts the periphery of the second recess 12 and restricts the range or the maximum angle of rotation of the rotatable member 41. The first hat 42, the resilient member 43 and the second hat 44 are located in the restriction slot 412. The resilient member 43 is located between the first and second hats 42, 44, and the first hat 42 is mounted a part of the second hat 44. The first hat 42 is biased by the resilient member 43 and contacts the curved recess 32 of the pawl 30. The outside of the first hat 42 contacts the first face 34. The second hat 44 is biased by the resilient member 43 and contacts the positioning portion 14 to position the rotatable unit 40. The first face 34 restricts the first hat 42, the first hat 42 restricts the rotatable member 41 and the rotatable member 41 is located in the third recess 13. The ring-shaped cover 50 is engaged with the cover groove 15 and has an accommodating groove 51 which is located corresponding to the engaging groove 16. The C-shaped clip 60 is engaged with the accommodating groove 51 and the engaging groove 16 so as to restrict the cover 50 in the cover groove 15. The clip 60 has two holes 61 respectively defined in two ends thereof and the two holes 61 are located in the notch 17.

Figure 6:
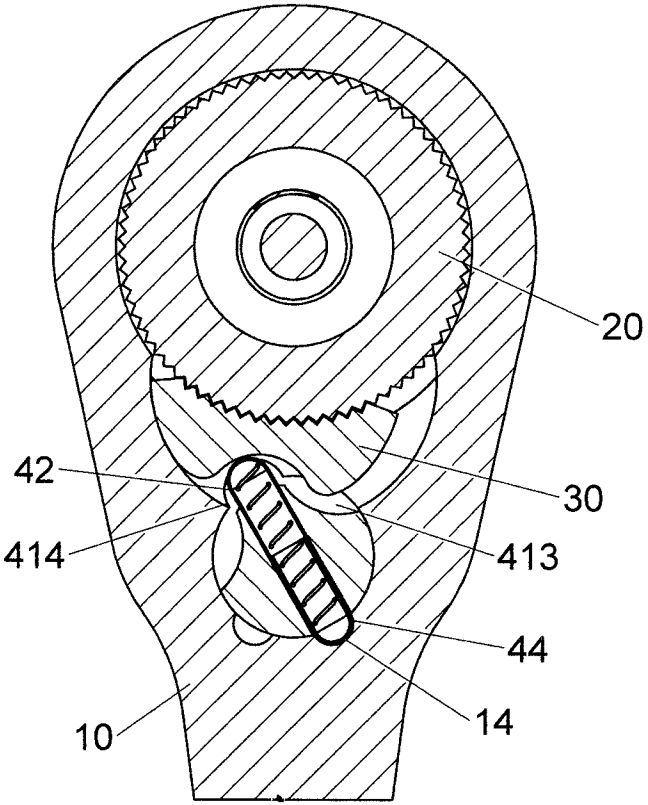
FIG. 6 is a cross sectional view, taken along line A-A in FIG. 5.
Figure 5:
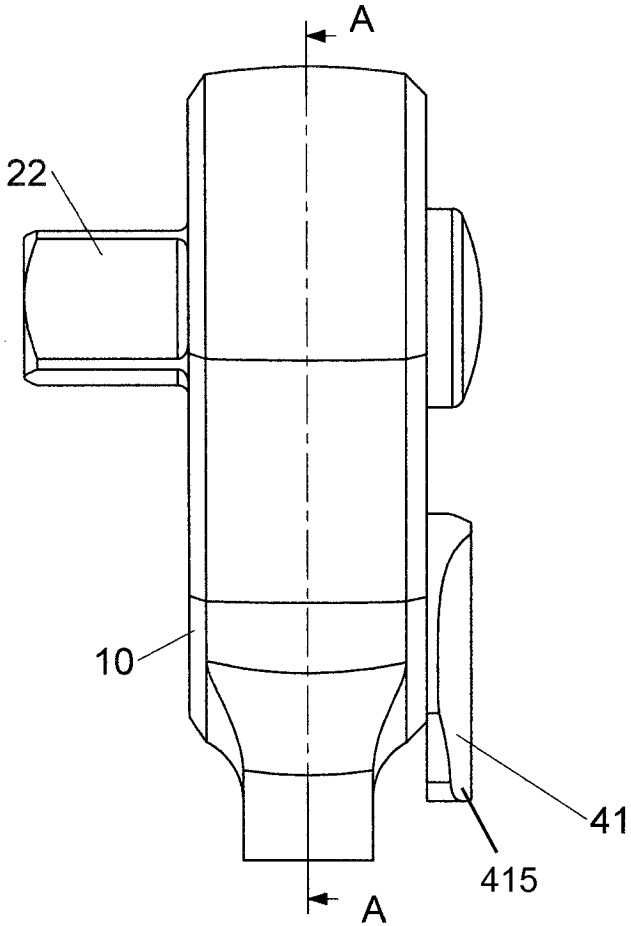
FIG. 5 is a side view of the ratchet wrench of the present invention.

As shown in FIGS. 5 and 6, when the ratchet wrench is rotated counter clockwise, the ratchet wheel 20 is pivotably located in the first recess 11 and the pawl 30 is located at one side of the second recess 12. The right top surface 413 of the rotatable member 41 contacts the second face 35 of the pawl 30. The first hat 42 contacts the curved recess 32 and contacts the first face 34. One of the flanges 414 of the rotatable member 41 contacts the periphery of the second recess 12 so that the flange 414 restricts the maximum angle of rotation of the rotatable member 41. The second hat 44 is biased by the resilient member 43 and contacts the positioning portion 14 so as to position the rotatable unit 40. The operation portion 415 of the rotatable member 41 is exposed from outside of the ratchet wrench 10 for the user to operate.

Figure 7:
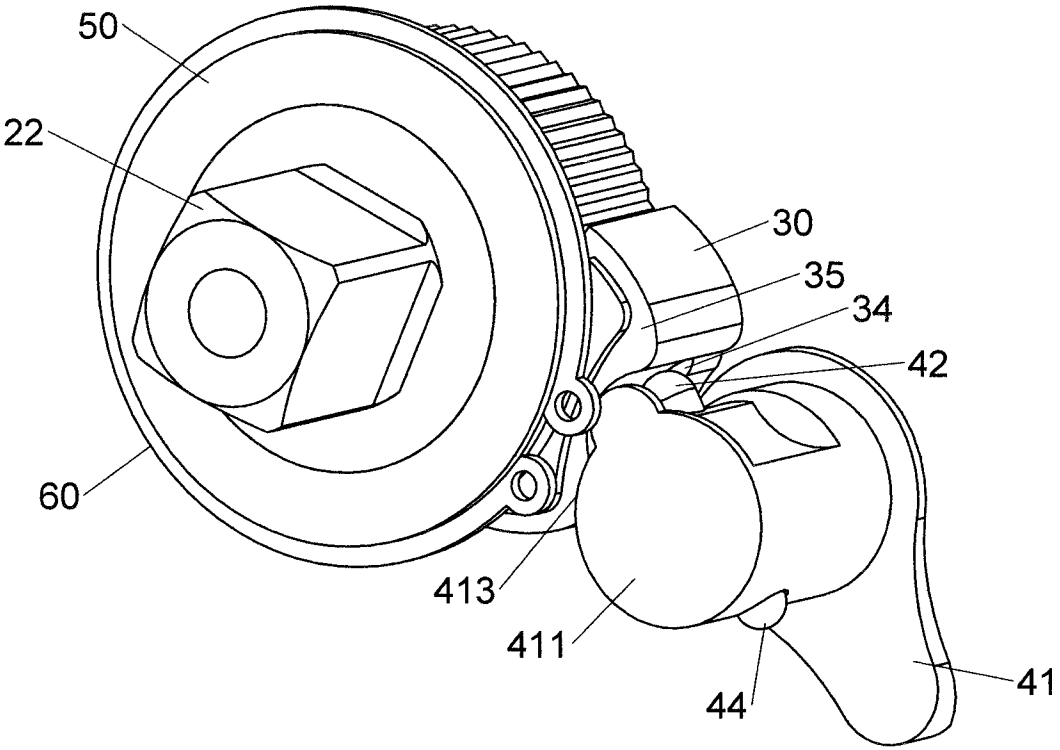
FIG. 7 shows that the rotatable unit is rotated.

As shown in FIG. 7, the pawl 30 is located in one side of the second recess 12 and the top surface 413 of the rotatable member 41 contacts the second face 35 of the pawl 30. The first hat 42 contacts the curved recess 32 and contacts the first face 34. The rotatable member 41 is pivotably located in the third recess 13.

Figure 8:
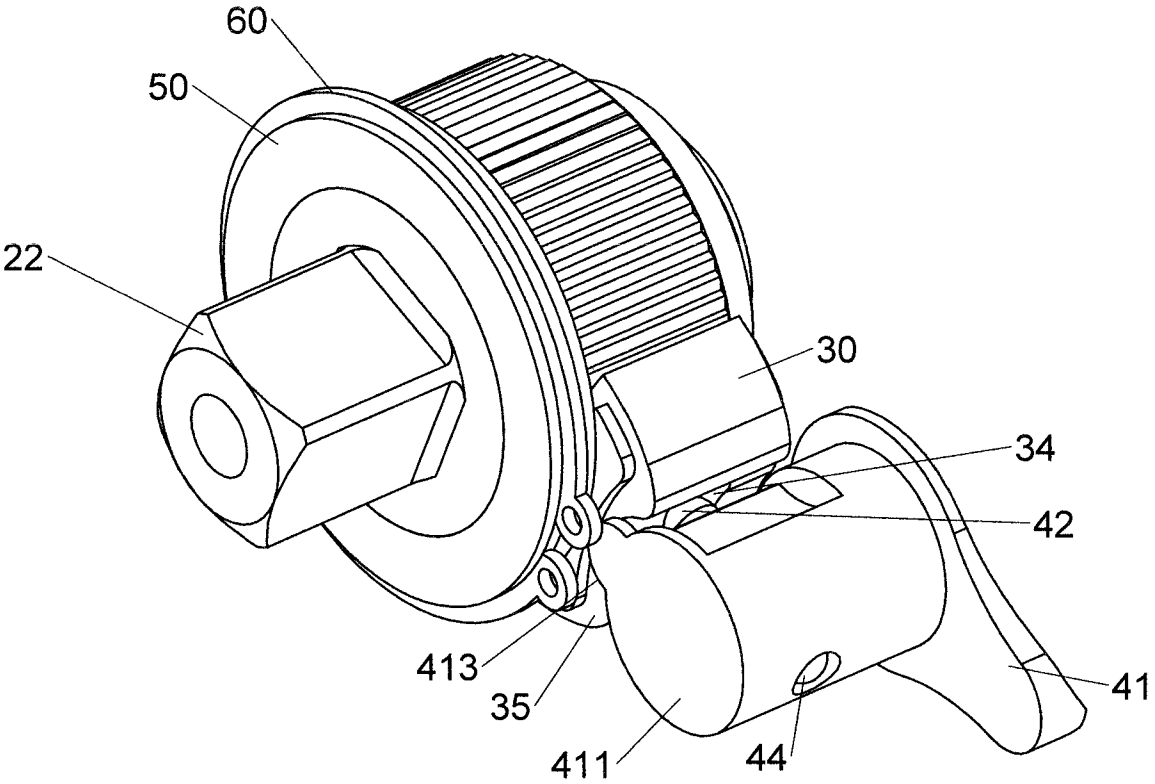
FIG. 8 shows that the rotatable member is switched to the middle position.

As shown in FIG. 8, when the rotatable member 41 is switch to the middle position, the pawl 30 is located at the middle of the second recess 12 and the middle top surface 413 of the rotatable member 41 contacts the second face 35 of the pawl 30. The first hat 42 contacts the first face 34. The rotatable member 41 is pivotably located in the third recess 13.

According to FIGS. 7 and 8, at least one of the top surfaces 413 contacts the second face 35 of the pawl 30, and the first hat 42 contacts the first face 34. The pawl 30 restricts the top surface 413 and the first hat 42. The first hat 42 is accommodated ion the restriction slot 412. The rotatable unit 40 is pivotably located in the third recess 13 and is not disengaged from the third recess 13. There are two restriction designs for the rotatable member 41 and which reduce the possibility that the rotatable member 41 is disengaged from the third recess 13 when the ratchet wrench receives an impact.

Figure 9:
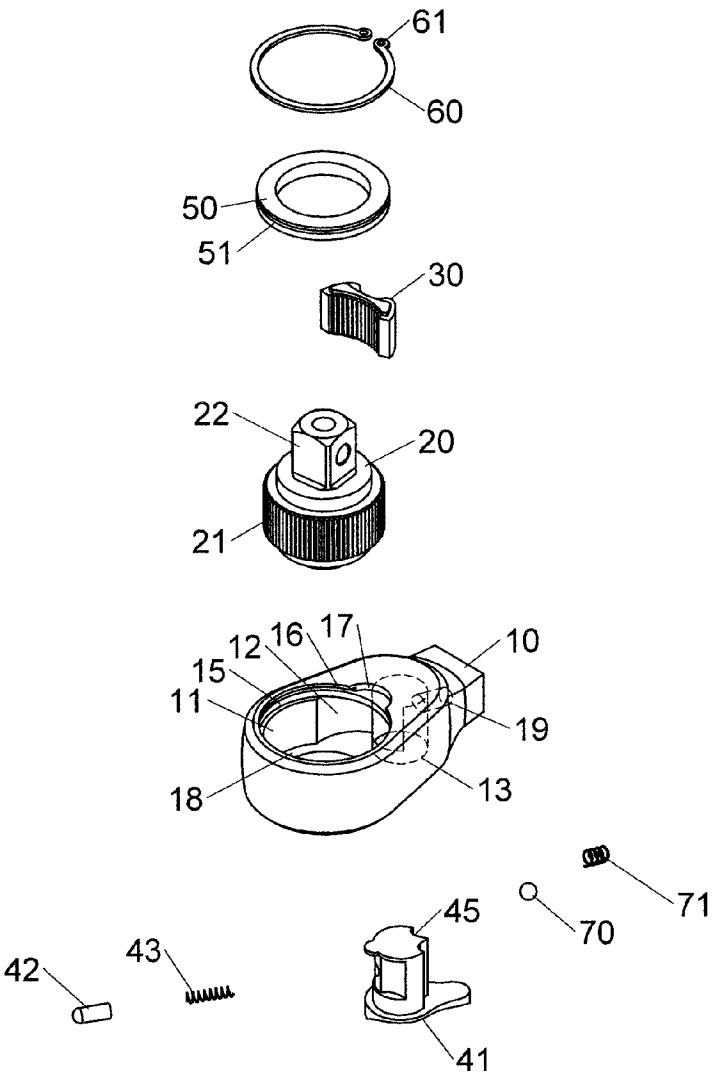
FIG. 9 is an exploded view to show the second embodiment of the ratchet wrench of the present invention.

FIG. 9 shows that the ratchet wrench 10 does not have the positioning portion 14 and the rotatable unit 40 does not have the second hat 44. A positioning hole 19 is located in the handle 100 and close to the third recess 13. The rotatable member 41 has two concaved portions 45. A bead 70 and a spring 71 are received in the positioning hole 19 and engaged with one of the two concaved portions 45. The bead 70 is biased by the spring 71 and contacts one of the two concaved portions 45. When the rotatable member 41 is operated in a first direction, the cone-shaped portion of the concaved portion 45 pushes the bead 70 which is moved by the spring 71 so that the bead 70 is moved to the other concaved portion 45 to position the rotatable unit 40.

Figure 10:
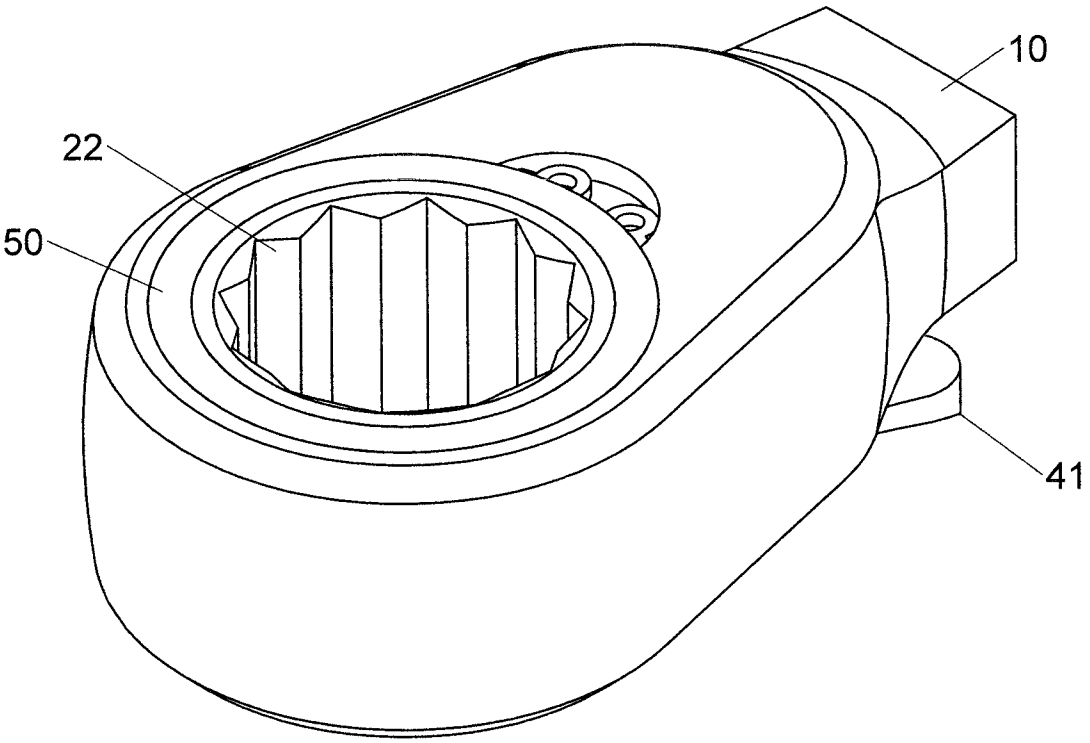
FIG. 10 is a perspective view to show the third embodiment of the ratchet wrench of the present invention.

As shown in FIG. 10, the mounting part 22 can be a polygonal recess such as hexagonal recess or dodecagonal recess.

The cover 50 and the ratchet wheel 20 may also be integral and the ratchet wheel 20 has the accommodating groove 51.

The protrusion 33 of the pawl 30 is functioned as a rib which bears more force so that the ratchet wrench 10 can bear higher torque. When the rotatable unit 40 is rotated in the third recess 13, one of the flanges 414 of the rotatable member 41 contacts the periphery of the second recess 12 to restrict the maximum angle of rotation of the rotatable member 41 to avoid the first hat 42 from hitting the periphery of the second recess 12.

While we have shown and described the embodiment in accordance with the present invention, it should be clear to those skilled in the art that further embodiments may be made without departing from the scope of the present invention.

What is claimed is:

1. A ratchet wretch comprising:

a handle and a function end connected to an end of the handle, the function end having a first recess and a second recess defined in an inner periphery of the first recess which communicates with the second recess, a center of the second recess located within the first recess, a third recess defined in the function end and communicating with the second recess, the third recess having an open end, two positioning portions located at the third recess and close to the handle;

a ratchet wheel rotatably located in the first recess and having ratchet teeth defined in an outer periphery thereof, the ratchet wheel having a mounting part extending therefrom;

a pawl located in the second recess and being movable in the second recess, the pawl having multiple engaging teeth defined in a front side thereof, the engaging teeth engaged with the ratchet teeth, the pawl having a curved recess defined in a rear side thereof, the pawl having a protrusion extending therefrom which is located close to the open end of the third recess, a first face defined between the protrusion and the curved recess, a second face defined in the pawl and located away from the open end of the third recess;

a rotatable unit located in the third recess and controlling the pawl to move in the second recess, the rotatable unit having a rotatable member, a first hat, a second hat and a resilient member;

the rotatable member having a circular rod which is pivotably connected to the third recess and has a restriction slot, the restriction slot located corresponding to the curved recess of the pawl, the restriction slot defined through the circular rod, the circular rod having three top surfaces which face the pawl, at least one of the top surfaces contacting the second face so that the rotatable member is not disengaged from the third recess, the top surface located at middle of the three top surfaces having a top flange on each of two sides thereof, when the rotatable unit is rotated in the third recess, one of the top flanges of the rotatable member contacts a periphery of the second recess and restricts a range of rotation of the rotatable member, and the first hat, the second hat and the resilient member located in the restriction slot, the resilient member located between the first and second hats, the first hat mounted to a part of the second hat, the first hat being biased by the resilient member and contacting the curved recess of the pawl, the second hat being biased by the resilient member and contacting one of the positioning portions to position the rotatable unit, an outside of the first hat contacting the first face which restricts the first hat, the first hat restricting the rotatable member and the rotatable member being located in the third recess.

2. The wrench as claimed in claim 1, wherein a top and a bottom of the second recess are closed.

3. The wrench as claimed in claim 1, wherein the first recess extends through the function end.

4. The wrench as claimed in claim 1, wherein the first recess has a lip extending from a bottom thereof and the ratchet wheel has a contact portion which contacts the lip.

5. The wrench as claimed in claim 1, wherein a positioning hole is located in the handle and close to the third recess, the rotatable member has two concaved portions, a bead and a spring are received in the positioning hole and engaged with one of the two concaved portions, the bead is biased by the spring and contacts one of the two concaved portions.

6. The wrench as claimed in claim 1, wherein a cover groove is defined in the inner periphery of the first recess and a diameter of the cover groove is larger than that of the first recess, an engaging groove is defined in an upper periphery of the cover groove, a notch is defined in a surface of the function end and communicates with the engaging groove, a ring-shaped cover is engaged with the cover groove and has an accommodating groove which is located corresponding to the engaging groove, a C-shaped clip is engaged with the accommodating groove and the engaging groove so as to restrict the cover in the cover groove, the clip has two holes respectively defined in two ends thereof and the two holes are located in the notch.

7. The wrench as claimed in claim 1, wherein the mounting part has a rectangular cross section.

8. The wrench as claimed in claim 1, wherein the mounting part is a polygonal recess.

* * * * *